United States Patent [19]

Himmert et al.

[11] Patent Number: 4,978,088

[45] Date of Patent: Dec. 18, 1990

[54] GUIDANCE MECHANISM FOR A SUBCALIBER-SIZED FIN-STABILIZED PRACTICE PROJECTILE

[75] Inventors: Rainer Himmert, Lauf; Heinrich Brand, Wendelstein; Josef Dommer; Erich Bock, both of Nuremberg, all of Fed. Rep. of Germany

[73] Assignee: Diehl GmbH & Co., Nuremberg, Fed. Rep. of Germany

[21] Appl. No.: 452,696

[22] Filed: Dec. 18, 1989

[30] Foreign Application Priority Data

Dec. 19, 1988 [DE] Fed. Rep. of Germany ..... 3842730
Oct. 4, 1989 [DE] Fed. Rep. of Germany ..... 3933100

[51] Int. Cl.[5] ..... F42B 13/20; F42B 13/32; F42B 13/16

[52] U.S. Cl. ..... 244/3.24; 102/529

[58] Field of Search ..... 244/3.23, 3.24, 3.25, 244/3.26, 3.27, 3.28, 3.29.3.3; 102/529, 501

[56] References Cited

U.S. PATENT DOCUMENTS

| | | | |
|---|---|---|---|
| 3,015,269 | 1/1962 | Potts, Jr. | 244/3.24 |
| 3,684,214 | 8/1972 | Kloss | 244/3.27 |
| 3,845,922 | 11/1974 | Mayer | 244/3.28 |
| 4,736,909 | 4/1988 | Boder et al. | 244/3.29 |
| 4,815,682 | 3/1989 | Feldmann et al. | 244/3.23 |

FOREIGN PATENT DOCUMENTS

| | | | |
|---|---|---|---|
| 2639445 | 3/1978 | Fed. Rep. of Germany | 244/3.24 |
| 2844870 | 5/1980 | Fed. Rep. of Germany . | |
| G8710457 | 7/1987 | Fed. Rep. of Germany . | |
| 1307270 | 4/1902 | France | 244/3.24 |
| 0817907 | 9/1937 | France | 244/3.24 |
| 0378666 | 2/1940 | Italy | 244/3.24 |
| 0147200 | 5/1952 | Switzerland | 244/3.27 |

*Primary Examiner*—Charles T. Jordan
*Assistant Examiner*—Michael J. Carone
*Attorney, Agent, or Firm*—Scully, Scott, Murphy & Presser

[57] ABSTRACT

A guidance mechanism for a subcaliber-sized fin-stabilized practice projectile including wings or vanes which are radially fixedly arranged on the shank of the projectile. The wings or vanes possess auxiliary vanes which extend transversely of their main axes, and wherein a hole which is produced in a target board by the fin-stabilized practice projectile corresponds, in general, with the diameter of a circle about which the auxiliary vanes are located on the projectile.

6 Claims, 2 Drawing Sheets

GUIDANCE MECHANISM FOR A SUBCALIBER-SIZED FIN-STABILIZED PRACTICE PROJECTILE

BACKGROUND OF THE INVENTION

1. Field of the Invention

The present invention relates to a guidance mechanism for a subcaliber-sized fin-stabilized practice projectile including wings or vanes which are radially fixedly arranged on the shank of the projectile.

It is intended that guidance mechanisms for subcaliber-sized fin-stabilized projectiles should evince the least possible air resistance or aerodynamic drag. When projectiles of that kind, especially those of the respective practice version, are fired against target boards, then the observation of any deviation in the hits in the target is rendered extremely difficult because of the relatively small holes fired therethrough.

2. Discussion of the Prior Art

Thus, in any case, there are known conical hole guidance mechanisms for practice ammunition from the disclosure of German Patent No. 28 44 870 C2, which punch large, easily discernable holes into the target boards. The air resistance of these guidance mechanisms; however, is substantially higher than that of live or battle ammunition. Moreover, the external ballistics deviates significantly from that of live or battle ammunition, especially along greater firing distances or ranges.

SUMMARY OF THE INVENTION

Accordingly, it is an object of the present invention to propose a guidance mechanism which, with only a slight deterioration in the aerodynamic drag coefficient in contrast with that of live or battle ammunition, will produce sufficiently large holes in the target discs or boards to facilitate the observation of hits in the target.

The present invention solves this particular object in that the wings or vanes possess auxiliary vanes which extend transversely of their main axes.

In accordance with a specific feature of the invention, as set forth hereinabove there is afforded the advantage that the hole which is produced in the target board by the fin-stabilized practice projectile corresponds, in general, with the diameter of the circle about which the auxiliary vanes are located on the projectile.

Pursuant to a further aspect of the invention, this large hole in the target is attained notwithstanding the presence of an open space between the ends of neighboring auxiliary vanes. This is because the remaining interconnections in the target board are then so narrow that, in dependence upon the target plate material, such as wood, they can be either broken out or bent open.

The inventive structure also provides for an expedient aerodynamic drag coefficient, in that the auxiliary vanes have cutting edges with oblique surfaces located in the oncoming airflow, and these auxiliary vanes possess a stabilizing fin configuration, and without exerting any adverse influence over the effect of the fin-stabilized practice projectile within the target board. The oblique surfaces of the auxiliary vanes assist in the breaking-off of the interconnections through the introduction of resultant forces into the breakable or splinterable target plate material.

In accordance with another embodiment of the invention, the auxiliary vanes may be constituted from a web or band of high-strength spring steel. This possesses the required stability during firing and upon passage through the target plate.

In accordance with a specific feature of the invention, the guidance mechanism includes at least three vanes with auxiliary vanes, and the auxiliary vanes measured along their length, are arranged at, respectively, an open distance from the front and rear edges of the vanes.

Pursuant to a modified embodiment of the invention, due to the longitudinal offset of the double-wing auxiliary vanes which are constituted from a single piece, the mounting of the auxiliary vanes into the openings of the wings can be quickly and simply effectuated without any mutual hindrances.

According to an important modified embodiment, the auxiliary vanes are alternatingly longitudinally offset by a certain distance relative to each other. Due to this longitudinal offset of the double-finned auxiliary vanes which are constituted from a single-piece, the mounting of the auxiliary vanes in the openings of the vanes is rapidly and simply possible without any mutual hindrance.

As disclosed in another equally important variant of the invention, the novel fin-stabilized practice projectile also produces a large, easily recognizable hole in a target board which is constituted from a weather-resistant target material which possesses a high degree of toughness, such as fleece (non-woven). Through the arrangement of the auxiliary vanes there is achieved that the target material is completely cut out, such as in a closed profile (ring). Notwithstanding this aspect, the air resistance or drag increases only relatively slightly and, above all, lies significantly below the impermissibly high air resistance or drag of a corresponding closed profile.

A secure and simple fastening of the auxiliary vanes in the vanes or wings, and an inexpensive construction of the auxiliary vanes is afforded by the present inventive structure, and additional fastening means are not required. The auxiliary wings are seated under a prestressing and with a form-fit in the openings of the vanes or wings.

BRIEF DESCRIPTION OF THE DRAWINGS

Reference may now be had to the following detailed description of exemplary embodiments of the invention, taken in conjunction with the accompanying drawings; in which.

DETAILED DESCRIPTION

Figure 2:
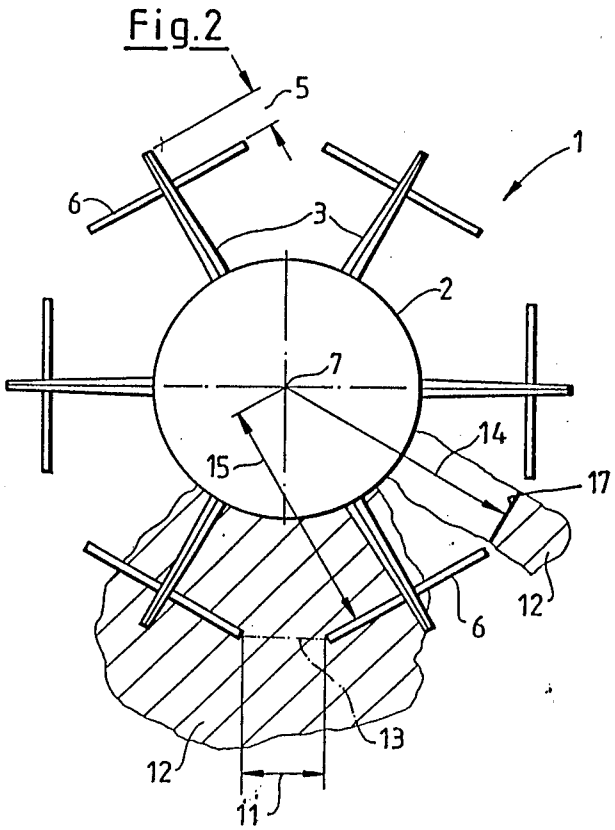
FIG. 2 illustrates an end view of the guidance mechanism of FIG. 1.
Figure 1:
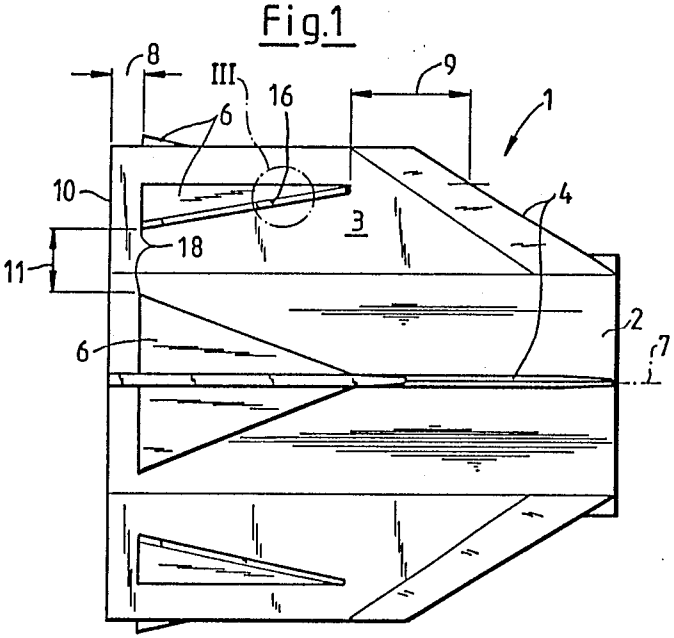
FIG. 1 illustrates a side view of a guidance mechanism constructed pursuant to the invention.

A guidance mechanism 1 is constituted from a tubular guidance member 2 with six wings or vanes 3. These wings or vanes, in a manner known per se, are equipped with sharpened edges 4.

Arranged on the wings 3 at a spacing 5 therefrom are sharpened, fin-stabilizer-like auxiliary vanes 6 with cutting edges 16. Corresponding oblique edges 23 are located, pursuant to FIG. 3, facing in a direction towards the guidance member 2. The auxiliary vanes 6 are located at right angles relative to a radial distance 15 from the axis of a guidance mechanism and, in effect, at respective distances 8, 9 from the outer edges 4 and 10 of the vane 3.

The auxiliary vanes 6, relative to the radial length of the wings 3, are arranged somewhat at a ⅓ distance 5 in the direction of a guidance mechanism member 2.

An open space 11 between the ends 18 of neighboring auxiliary vanes 6 consists of about 40 or 50% of the radial length of the vanes 3.

As suitable materials for the guidance mechanism 1 have been determined to be aluminum alloy for the guidance mechanism 1 and a high-strength spring steel band for the auxiliary vanes 6.

During the penetrating of a target by a subcaliber fin-stabilized practice projectile (not shown) in which the target is a target board 12, any remaining interconnection 13 is so narrow that the latter, in dependence upon the material of the target board, is either broken out or bent open in the direction of firing. Hereby, a radius 14 of a hole 17 produced in the target board 12 corresponds generally to the spacing 15 of the auxiliary vane 6 from the axis 7 of the guidance mechanism.

Essential to the invention is the aerodynamically expedient arrangement of the auxiliary vanes 6 with regard to the guidance mechanism member 2. Through the mutual spacing 11 of the auxiliary vanes 6 with regard to each other and with reference to of the guidance mechanism member 2, this will readily afford that the aerodynamic drag of the air resistance of the guidance mechanism is not substantially higher than that for a guidance mechanism 1 without auxiliary vanes 6.

Figures 3, 4, 5, 6, 7, 8:
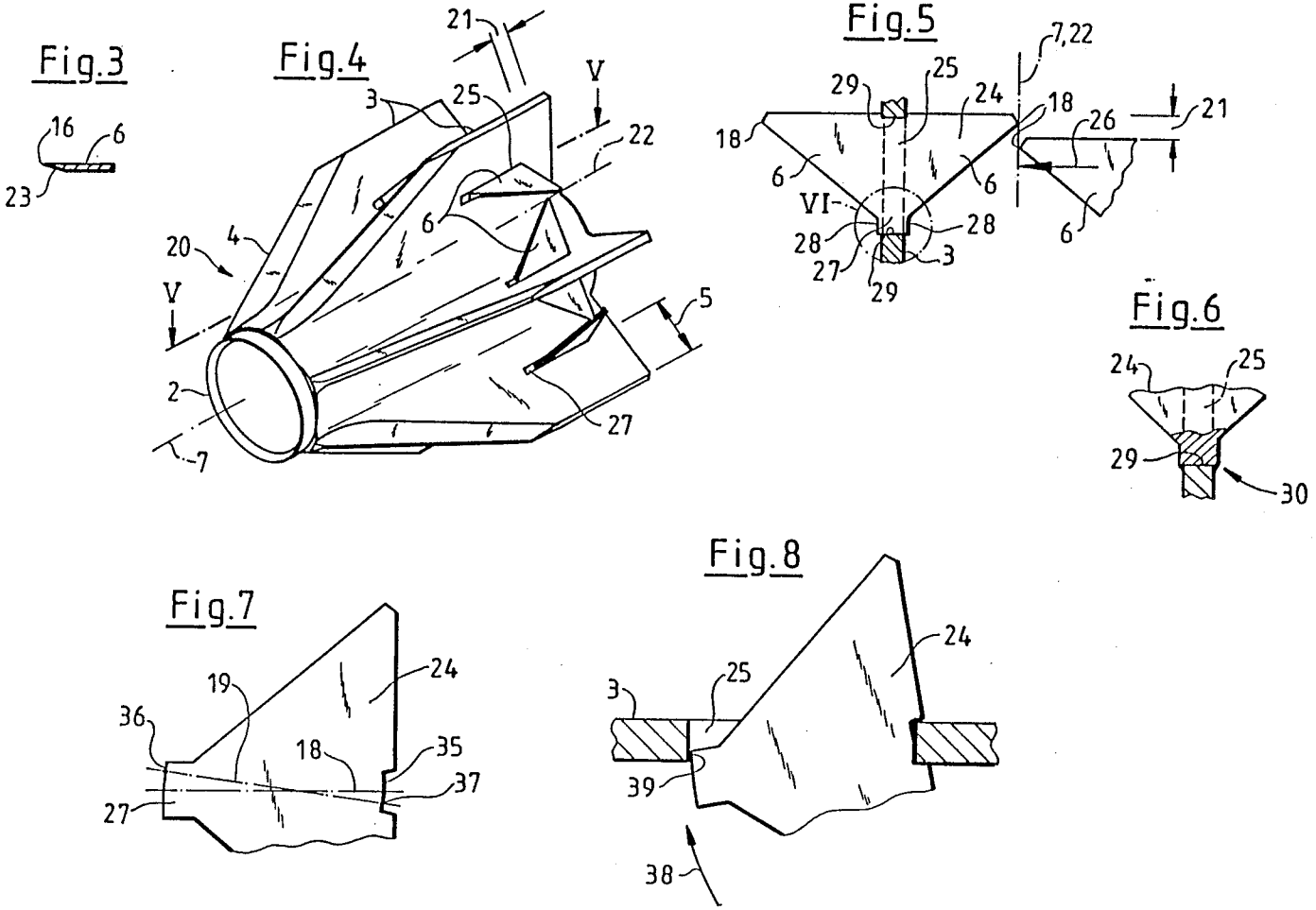
FIG. 3 illustrates a detail from the encircled portion III in FIG. 1.
FIG. 4 illustrates a perspective view of a further embodiment of a guidance mechanism.
FIG. 5 illustrates a sectional view taken along line V—V in FIG. 4.
FIG. 6 illustrates a detail from the encircled portion VI in FIG. 5.
FIGS. 7 and 8 respectively, show further details taken along line V—V in FIG. 4.

Pursuant to FIG. 4, a guidance mechanism 20, in a deviation from the construction of the above-described exemplary embodiment, possesses the auxiliary wings 6 which are longitudinally or axially offset by a distance 21. The distance 21 extends in parallel with the axis 7 of the guidance mechanism.

The ends 18 of the auxiliary vanes 6 are located along a single line 22, as shown in FIGS. 4 and 5. Their mutual offsets, measured at right angles relative to the axis 7 of the guidance mechanism, is thereby zero.

For each individual vane 3 there are provided two auxiliary vanes 6. These two auxiliary vanes 6 are constituted of a single piece 24, as shown pursuant to FIG. 5. The piece 24 is insertable into an opening 25 provided in the vane 3 in the direction of arrow 26, without any hindrance from the neighboring auxiliary vanes 6. In a line of symmetry 18, a protuberance 27 points with a material excess 28 on both sides thereof towards the vanes and a cutout 35, as shown in FIG. 7. Inclined surfaces 36, 37 on one side of the piece 24 facilitate the assembly in the opening 25 in the direction of the arrow 38. The asymmetrically arranged inclines 36, 37, which are diagonally located opposite each other on one line 19, allow for a minimum axial play 39 between the piece 24 and the vane 3. The secure fastening of the piece 24 in the vane 3 is thereby simplified. Consequently, it is also possible to provide thereby, in a single manner, an error-free assembly and positioning of the piece 24 in the installing orientation pursuant to FIGS. 5, 6, for effectuating the riveting procedure.

For the form-fitted and load-transmissive connection of the piece 24 with the vane 3, the material excess 25 is plastically deformed on both sides thereof in the type of the known riveting sequence. As a result thereof, the piece 24 is positioned under the action of prestressing against the end surfaces 29 (FIGS. 5 and 6) of the opening 25, and at location 30 evidences a form-fit. This two-sided form-fit, in conjunction with the prestressing, allows for the secure fastening of the pieces 24 during firing, during the flight of the projectile and in the target.

The guidance mechanism 20 of a subcaliber-sized practice projectile (not shown) produces a readily recognizable hole in an extremely strong target material, such as fleece (non-woven). The tongues or flaps (not shown) which remain in the target material upon employment of the guidance mechanism 1 between the vane penetrations, in the guidance mechanism 20 due to the auxiliary vanes, which in projection because of the zero offset, are generally ring-shaped closed in form, are completely cut out due to the zero spacing.

Notwithstanding this arrangement for the auxiliary vanes 6, the value in the aerodynamic drag of the guidance mechanism 20 is maintained within acceptable bounds.

The zero offset along the line 22 can be varied within narrow bounds. The ends 18 can slightly superimpose themselves; however, they can also show a small open space. The open space is contingent upon the rupture strength or tear resistance of the target material.

What is claimed is:

1. A guidance mechanism for a subcaliber fin-stabilized practice projectile comprising a plurality of radial vanes fastened circumferentially spaced on a cylindrical body of said guidance mechanism, each of said radial vanes mounting auxiliary vanes extending transversely of the main radial axis of each of said radial vanes, said auxiliary vanes on adjacently arranged radial vanes being alternatingly axially offset by a predetermined distance relative to each other.

2. A guidance mechanism as claimed in claim 1, wherein said auxiliary vanes have sharpened leading edges with oblique surfaces facing an oncoming airflow directed against said guidance mechanism.

3. A guidance mechanism as claimed in claim 1, wherein said auxiliary vance are constituted from a band of a high-strength spring steel.

4. A guidance mechanism as claimed in claim 1, wherein the distance between the neighboring ends of auxiliary wings mounted on adjacent of said radial vanes is zero measured in the circumferential direction of said auxiliary vanes.

5. A guidance mechanism as claimed in claim 1, wherein the auxiliary vanes extend from the opposite sides of each of said radial vanes, each said auxiliary vane being constituted from a single piece, each said piece being form-fittingly and load-transmissively fastened in an opening formed in each respective radial vane.

6. A guidance mechanism as claimed in claim 5, wherein each said piece includes a protuberance along a symmetrical line positioned at one end within said opening with excess material on both sides of said opening and a cutout in said piece engaging the other end of said opening; and inclines on the protuberance and in the cutout being asymmetrically arranged along a single line diagonally opposite each other.

* * * * *

UNITED STATES PATENT AND TRADEMARK OFFICE

CERTIFICATE OF CORRECTION

PATENT NO. : 4,978,088

DATED : December 18, 1990

INVENTOR(S) : Rainer Himmert, et al.

It is certified that error appears in the above-identified patent and that said Letters Patent is hereby corrected as shown below:

Column 4, line 46, Claim 3: "vance" should read as --vanes--

Signed and Sealed this

Fourteenth Day of July, 1992

*Attest:*

DOUGLAS B. COMER

*Attesting Officer*

*Acting Commissioner of Patents and Trademarks*